US005430691A

United States Patent [19]

Fridman

[11] Patent Number: 5,430,691

[45] Date of Patent: Jul. 4, 1995

[54] SHOCK WAVE GENERATOR

[76] Inventor: Igor Fridman, 56/3 Harav Kook St., Netanya 42261, Israel

[21] Appl. No.: 250,010

[22] Filed: May 27, 1994

[51] Int. Cl.[6] ..... H04R 23/00

[52] U.S. Cl. ..... 367/145; 181/117; 116/137 R; 116/137 A

[58] Field of Search ..... 116/137 R, 137 A; 367/145, 147; 181/116, 117, 118

[56] References Cited

U.S. PATENT DOCUMENTS

| | | | |
|---|---|---|---|
| 3,545,562 | 12/1970 | Gundlach | 181/0.5 |
| 3,685,808 | 8/1972 | Bodai | 261/1 |
| 4,189,026 | 2/1980 | Elliot et al. | 181/118 |
| 4,193,472 | 3/1980 | Kirby | 181/118 |
| 4,645,542 | 2/1987 | Scharton et al. | 134/1 |
| 4,655,846 | 4/1987 | Scharton et al. | 134/1 |

*Primary Examiner*—J. Woodrow Eldred
*Attorney, Agent, or Firm*—Wolf, Greenfield & Sacks

[57] ABSTRACT

A two-phase shock wave generator including a combustion chamber including a first, combustion, portion having an input port and a second, detonation, portion downstream of the first portion and having an output aperture; an air-fuel supply line, operative to feed the input port with an air-fuel mixture, an igniter, associated with the air-fuel supply line, which ignites the air-fuel mixture in the supply line and initiates a burning front which propagates towards the input port and a turbulence stimulator, fixedly mounted in the combustion chamber, which enhances and controls burning of the air-fuel mixture and includes a first section, situated within the combustion portion of the combustion chamber and having a preselected first gas dynamic resistance and a second section, situated within the detonation portion of the combustion chamber and having a preselected second gas dynamic resistance, lower than the first resistance, wherein the first resistance is such that burning of the air-fuel mixture in the combustion portion yields a predetermined pressure level suitable for initiating detonation of the remaining air-fuel mixture, in the detonation portion, and wherein the second resistance supports continued detonation of the remaining air-fuel mixture in the detonation portion.

13 Claims, 1 Drawing Sheet

SHOCK WAVE GENERATOR

FIELD OF THE INVENTION

The present invention relates to combustion and explosion processes in general, more particularly, to the use of combustion or explosion processes for industrial application, such as cleaning of industrial equipment and machinery by devices employing these processes.

BACKGROUND OF THE INVENTION

Proper maintenance of industrial machinery generally includes frequent removal of undesired accumulations of particles on different elements of the machinery. Particles accumulation on the machinery parts can be minimalized by cleaning the environment surrounding the machinery. Various air cleaning devices have been used for that purpose.

Although a clean working environment reduces particle accumulation on the machinery parts, it cannot prevent such accumulation completely. Thus, more direct methods for cleaning the machinery parts are often required.

It is known that efficient cleaning of various machinery parts may be achieved by generating shock waves in the vicinity of the parts thereby "shaking off" dust particles and other accumulations from the parts. Alternatively, the shock waves may be induced onto a machinery part, causing the part to vibrate and "shake off" the accumulations. Shock wave cleaning is particularly useful for elements which are not readily removed for cleaning and/or elements which are particularly susceptible to the use of other cleaning methods and/or cleaning materials.

Gas dynamic generators which induce shock wave vibrations in their vicinity are known in the art. When a gas dynamic generator is placed near a machinery element to be cleaned, the shock waves induced in the vicinity of the element can be utilized to clean the element, as described above. Gas dynamic generators are useful aids in the production of construction materials and apparatus, metallurgy, mining, the chemical industry, oil processing and the food industry.

Gas dynamic generators have been used in the past, for example, for cleaning dust accumulation and other deposits in a centrifugal compressor. The centrifugal compressor includes a pumping wheel with pumping blades mounted in a pumping chamber. Nozzles, which are connected to a source of pressured gas via a gas channel, are mounted in the pumping chamber at a preselected distance from the pumping blades. The source generates high pressure gas pulses which impinge on the pumping blades thereby removing undesired accumulations from the blades. For optimal results, the distance between the nozzles and the pumping blades is selected to be between 1 and 1.5 times the diameter of the gas channel.

Gas dynamic generators have also been used for cleaning contaminated electrodes, particularly for purifying electrodes of electrofilters. An ignited air-fuel mixture is transported through an elongated detonation chamber, in which the burning mixture develops a high velocity, and is released onto a shock receiving plate which is associated with a shock transporting block. The block carries shock waves produced in the plate to the electrodes, thereby causing high acceleration vibrations in the electrodes to "shake off" the deposits.

Although existing gas dynamic pulse generators are useful for some applications, such as for cleaning compressor blades and removing deposits from electrodes, these systems generally suffer from high energy consumption and low operating efficiency. The output pressures obtained by devices as described above generally does not exceed 10–12 bars and, even then, most of the gas dynamic energy is not utilized since only a fraction of the pulsed gas dynamic energy is converted into shock waves in the part to be cleaned. Additionally, since the burning rate of the air-fuel mixture is relatively low (typically 400–500 meters per second) compared to the expansion rate of the mixture, only part of the mixture (typically non more than 30%) is utilized to produce the gas dynamic pulses. This difference between the burning rate and the expansion rate may also result in undesirable release of a flammable air-fuel mixture, thereby reducing the efficiency of the system and endangering the persons operating the system.

SUMMARY OF THE INVENTION

The present invention seeks to provide a more efficient and more powerful method and apparatus for generating gas dynamic pulses, e.g. shock waves. A shock wave generator constructed and operative in accordance with the present invention may be utilized to remove various deposits from industrial machinery parts, for example to clear clogged pipes or to ensure free flow of dry materials.

In accordance with a preferred embodiment of the present invention there is thus provided a two-phase shock wave generator including a combustion chamber including a first, combustion, portion having an input port and a second, detonation, portion downstream of the first portion and having an output aperture; an air-fuel supply line, operative to feed the input port with an air-fuel mixture, an igniter, associated with the air-fuel supply line, which ignites the air-fuel mixture in the supply line and initiates a burning front which propagates towards the input port and a turbulence stimulator, fixedly mounted in the combustion chamber, which enhances and controls burning of the air-fuel mixture and includes a first section, situated within the combustion portion of the combustion chamber and having a preselected first gas dynamic resistance and a second section, situated within the detonation portion of the combustion chamber and having a preselected second gas dynamic resistance, lower than the first resistance, wherein the first resistance is such that burning of the air-fuel mixture in the combustion portion yields a predetermined pressure level suitable for initiating detonation of the remaining air-fuel mixture, in the detonation portion, and wherein the second resistance supports continued detonation of the remaining air-fuel mixture in the detonation portion.

In a preferred embodiment of the present invention, the air-fuel supply line is associated with the input port via a perforated nozzle which scatters the burning front substantially upon entry of the burning front into the combustion chamber.

Additionally, in a preferred embodiment of the invention, the turbulence generator includes a plurality of gas dynamic obstructers positioned at fixed locations along the combustion chamber to yield the preselected first and second gas dynamic resistances along the combustion and detonation portions, respectively.

Preferably, each obstructer includes a plurality of rods, generally perpendicular to the direction of propagation of the burning front in the combustion chamber.

In a preferred embodiment of the invention, the plurality of rods are arranged along a generally helical path, having a predetermined pitch.

Alternatively, in accordance with a preferred embodiment of the invention, there is provided a shock wave generator including:

a combustion chamber having an input port and an output aperture;

an air-fuel supply line operative to feed the input port with an air-fuel mixture;

an igniter, associated with the air-fuel supply line, which ignites the air-fuel mixture in the supply line and initiates a burning front which propagates towards the input port;

a turbulence stimulator, fixedly mounted in the combustion chamber, which enhances and controls burning of the air-fuel mixture; and a perforated nozzle, associated with the input port, which scatters the burning front substantially upon entry of the burning front into the combustion chamber.

Further, in accordance with a preferred embodiment of the invention, there is provided a method of generating a shock wave using a two-phase burning process, including the steps of:

supplying an air fuel mixture from an air-fuel supply line to a combustion chamber;

igniting the air-fuel mixture in the supply line when the combustion chamber is filled with a preselected amount of air-fuel mixture, thereby initiating a burning front propagating towards the combustion chamber; and;

enhancing and controlling the burning process by stimulating turbulence in the combustion chamber, wherein turbulence is stimulated by the steps of:

imposing a preselected first gas dynamic resistance in the combustion portion during a first, combustion, phase of the burning process; and imposing a preselected second gas dynamic resistance, lower than the first gas dynamic resistance, during a second, detonation, phase of the burning process, and wherein the first resistance is such that burning of the air-fuel mixture during the combustion phase yields a predetermined pressure level suitable for initiating detonation of the remaining air-fuel mixture, during the detonation phase, and wherein the second resistance supports continued detonation of the remaining air-fuel mixture.

Preferably, the method further includes the step of scattering the burning front substantially upon entry of the burning front into the combustion chamber.

Alternatively, in accordance with a preferred embodiment of the invention, there is provided a method of generating a shock wave including the steps of:

supplying an air fuel mixture from an air-fuel supply line to a combustion chamber;

igniting the air-fuel mixture in the supply line when the combustion chamber is filled with a preselected amount of air-fuel mixture, thereby initiating a burning front propagating towards the combustion chamber;

enhancing and controlling the burning process by stimulating turbulence in the combustion chamber;

scattering the burning front substantially upon entry of the burning front into the combustion chamber; and detonating the air fuel mixture in the combustion chamber.

In a preferred embodiment of the invention, the method further includes the step of removing the detonated mixture at an output aperture to form a gas dynamic pulse thereat.

BRIEF DESCRIPTION OF THE DRAWINGS

The present invention will be better understood from the following detailed description of preferred embodiments of the invention, taken in conjunction with the accompanying drawings in which.

DETAILED DESCRIPTION OF A PREFERRED EMBODIMENT

Figure 1:
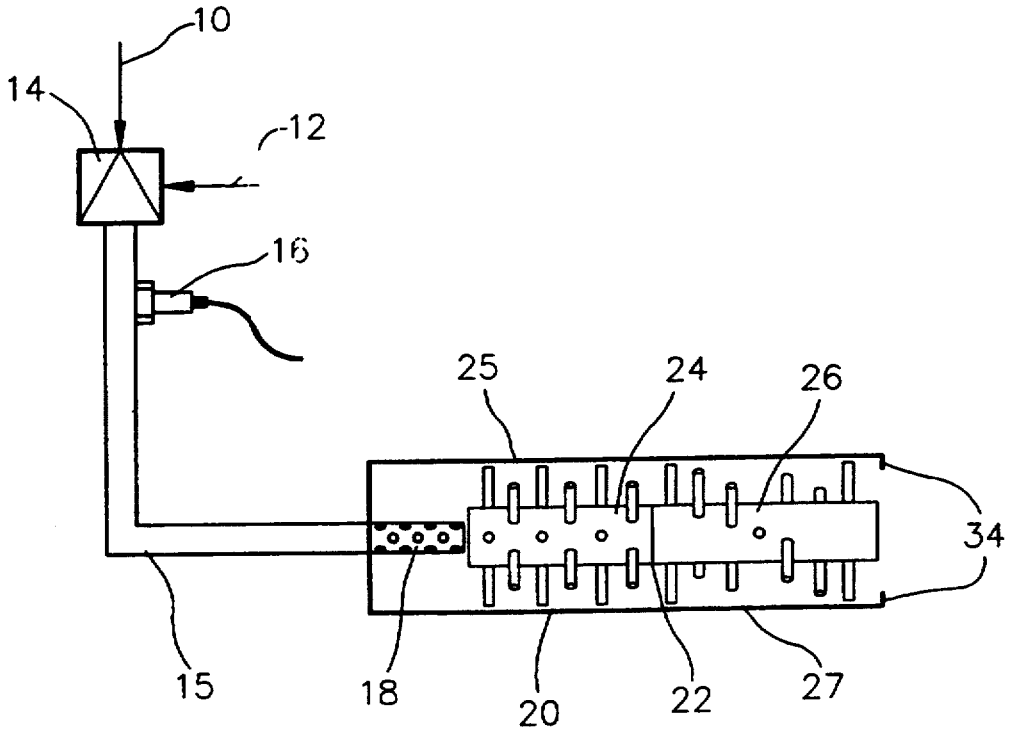
FIG. 1 is a schematic, cross-sectional, illustration of a gas dynamic pulse generator, constructed and operative in accordance with a preferred embodiment of the present invention.

Reference is now made to FIG. 1, which schematically illustrates a preferred embodiment of the gas dynamic pulse generator of the present invention. As shown in FIG. 1, the gas dynamic pulse generator preferably includes a fuel supply line 10, an air supply line 12, a mixer 14, an air-fuel mixture carrier line 15, an igniter 16 associated with a preselected portion of carrier line 15, a perforated nozzle 18 mounted to the end of carrier line 15, a combustion chamber 20 and a two-phase turbulence stimulator 22 mounted in combustion chamber 22.

Fuel, preferably a combustible gas such as Methane ($CH_4$), and air are compressed through lines 10 and 12, respectively, into mixer 14 at suitable pressures so as to provide, at the output of mixer 14, an air-fuel mixture having a preselected fuel to air ratio. Preferably, the fuel to air ratio provided by mixer 14 is higher than the ratio required for a normal chemical reaction between the fuel and the air. The air-fuel mixture is carried via carrier line 15 and released via perforated nozzle 18 into combustion chamber 20. Igniter 16, preferably a spark plug sealingly mounted into carrier line 15, is activated only after combustion chamber 20 has been filled with a predetermined amount of fuel-air mixture suitable for proper combustion.

Activation of igniter 16 initiates burning of the air-fuel mixture in carrier line 15, creating a burning front which propagates towards perforated nozzle 18. When the burning front reaches perforated nozzle 18, the front is broken and a scattered flame front is released into combustion chamber 20. Scattering of the burning front by nozzle 18 is preferred because it provides a considerably larger area of contact between the propagating burning front and the air-fuel mixture in combustion chamber 20. It should be appreciated that the increased contact area between the burning front and the air-fuel mixture provides more rapid combustion of the air-fuel mixture in combustion chamber 20. This initiates a first phase of the burning process, hereinafter referred to as the combustion phase.

Within combustion chamber 20, the burning front confronts two-phase turbulence stimulator 22 which enhances and expedites combustion of the air-fuel mixture in a controlled manner, as will now be described.

Figure 2:
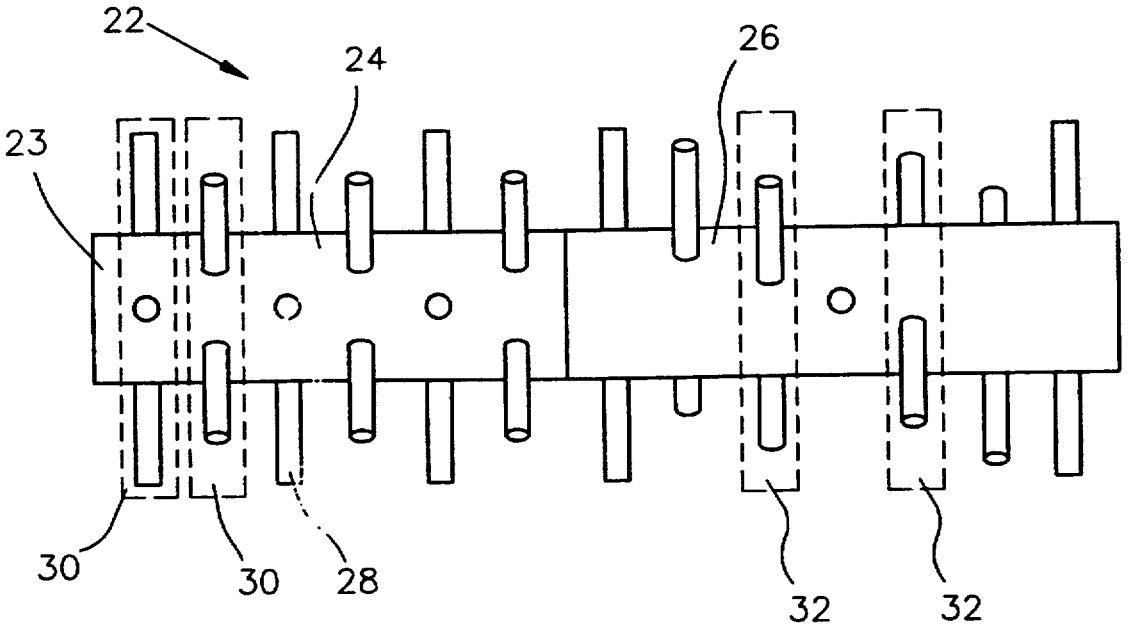
FIG. 2 is a pictorial, side view, illustration of a two-phase turbulence stimulator useful for the operation of the gas dynamic generator of FIG. 1 according to a preferred embodiment of the present invention.

FIG. 2 pictorially illustrates turbulence stimulator 22 in greater detail. As shown in FIG. 2, turbulence stimulator 22 is preferably composed of a longitudinal axis 23 and a plurality of radially extending rods 28 which are generally perpendicular to a longitudinal axis 23, i.e. generally perpendicular to the propagation direction of the burning front. In accordance with a preferred embodiment of the present invention, turbulence stimulator 22 includes a first section 24, associated with a first, combustion, portion 25 of combustion chamber 20, and a second section 26, associated with a second, detonation, portion 27 of combustion chamber 20. The spaces between neighboring rods 28 in first section 24 are preferably smaller than the spaces between neighboring rods 28 in second section 26. Additionally or alternatively, rods 28 in section 24 may be thicker than rods 28 in detonation section 26.

In a preferred embodiment of the invention, rods 28 of sections 24 and 26 of stimulator 22 are arranged in equiplanar groups, hereinafter referred to as obstructers 30 and 32, respectively. The number of rods in each obstructer may vary but, preferably, each obstructer 30 includes more rods 28 than each obstructer 32. For example, each of obstructers 30 may include four rods 28, arranged in the form of a cross, and each of obstructers 32 may include two radially aligned rods 28. The rods of successive obstructers, 30 or 32, are preferably angularly shifted such that the outward ends of rods 28 define a helical path having a preselected pitch. The pitch of the helical path defined by the ends of rods 28 is preferably selected, empirically, so as to produce optimal turbulence of the burning air-fuel mixture in combustion chamber 20.

In a preferred embodiment of the present invention, the radially outward ends of rods 28 do not touch the internal surface of combustion chamber 20. Preferably, there is a preselected distance, typically at least 2–3 millimeters, between the ends of rods 28 and the internal surface of chamber 20. This provides improved, turbulated, flow of the burning air-fuel mixture in combustion chamber 20.

Rods 28, which preferably have a diameter of between 10 and 14 millimeters, are operative to impose a predetermined resistance on the propagating burning gasses in combustion chamber 20 and, thereby, to control the gas pressure in combustion chamber 20 during the burning process. In a preferred embodiment of the invention, obstructers 30 and 32 are positioned along axis 23 with appropriate spacing so as to yield a desired burning sequence of the air-fuel mixture in combustion chamber 20, as described below.

Due to the generally thicker rods 28 in first section 24 and/or the greater number of rods 28 in each obstructer 30 and/or the closer spacing between successive obstructers 30 in first section 24, the resistance imposed by section 24 on gasses flowing therealong is generally greater than the resistance imposed on gasses flowing along second section 26. This results in a rapid build up of pressure as long as the burning front interacts with first section 24, reaching a peak suitable for detonation of the air-fuel mixture substantially when the burning front reaches the interface between section 24 and section 26. According to the present invention, the peak pressure reached by the burning front, at the interface between sections 24 and 26, is sufficient for initiating detonation of the remaining, unburnt, air-fuel mixture. Thus, the burning process undergoes a transition from the combustion phase, heretofore described, to a second phase of the burning process, hereinafter referred to as the detonation phase, in which the remaining air-fuel mixture is detonated.

As known in the art, detonation of the air-fuel mixture is initiated only when the pressure of the air-fuel mixture exceeds a suitable, threshold, pressure level. In a preferred embodiment of the invention, this threshold pressure level is exceeded substantially at the interface between portions 25 and 27 of combustion chamber 20.

As described above, the transition from the combustion phase to the detonation phase preferably occurs when the burning front is substantially at the interface between portions 25 and 27. At this point, the pressure building resistance provided by section 24 of stimulator 22 is no longer required. Nevertheless, in a preferred embodiment of the invention, second section 26 of stimulator 22 imposes some resistance on the propagating gas, as required for rapid yet complete and controlled detonation of the unburnt air-fuel mixture in detonation portion 27.

Since the gas dynamic resistance suitable for supporting detonation is generally lower than that suitable for pressure build-up, rods 28 are generally thinner along section 26 and/or obstructers 30 are less spaced apart then obstructers 32, as described above. Generally, the gas dynamic resistance imposed by a given obstructer 30 or 32 depends on the volume taken up by the given obstructer which, in turn, depends on the thickness and length of rods 28 and the number of rods 28 included in the given obstructer. For given thickness, length and number of rods 28 included in obstructers 30 and 32, the average gas dynamic resistances in portions 25 and 27 depends on the spacing between obstructers 30 and 32, respectively.

The detonation phase of the burning process produces a high pressure gas dynamic pulse, i.e. a shock wave, released through an output aperture 34 of chamber 20. The output pressure, in a preferred embodiment of the invention, is approximately 80 atmospheres or more. As known in the art, the shock wave released from aperture 34 or, preferably, a series of sequentially generated shock waves, may have various industrial application, such as cleaning of industrial machinery elements. It should be appreciated that the burning process described above, using perforated nozzle 18 and two-phase turbulence stimulator 22, provides a particularly efficient shock wave generator which is considerably more efficient than corresponding conventional shock wave generators.

It is appreciated that careful positioning of obstructers 30 and 32 along sections 24 and 26, respectively, is required in order to produce optimal two-phase shock wave generation. The present inventor has found that satisfactory results are obtained when obstructers 30 and 32 are spaced in accordance with the following empirical equation:

$$X = 10d/m$$

wherein:

X is the distance between successive obstructers, 30 or 32;

d is the average diameter of rods 28 in each obstructer, 30 or 32;

and m is the gas dynamic permeability of each obstructer, 30 or 32, in portions 25 or 27, respectively.

It will be appreciated that permeability m may be determined from the following formula:

$$m = s_c / s_t,$$

wherein:

$s_t$ is the cross-sectional area of the obstructer, 30 or 32, perpendicular to axis 23; and $s_c$ is the cross-sectional area of combustion chamber 20.

A working prototype, designed according to the present invention, was constructed on a combustion chamber having a diameter of 120 millimeters and a length of 4 meters. The obstructers in the first, 2.5 meter long, section of the turbulence stimulator included four rods, each having a diameter of 14 millimeters. The permeability of each obstructer in the combustion portion, determined as described above, was 3.5. Thus, according to the equation given above, the proper distance between successive obstructers in the first section was 40 millimeters.

The obstructers in the second section, the remaining 1.5 meters, of the turbulence stimulator included two rods, each having a diameter of 12 millimeters. The permeability of each obstructer in the detonation portion, determined as described above, was 2. Thus, according to the equation given above, the proper distance between successive obstructers in the second section was 20 millimeters.

Experiments with the above described prototype yielded an output shock wave having a power level approximately 5–7 times greater than that of conventional shock wave generators. The energy consumption of the prototype was approximately 2–3 times lower than that of conventional generators.

It will be appreciated by persons skilled in the art that the present invention is not limited to what has been thus far described. Rather, the scope of the present invention is limited only by the following claims.

I claim:

1. A two-phase shock wave generator comprising:

a combustion chamber including a first, combustion, portion having an input port and a second, detonation, portion downstream of said first portion and having an output aperture;

an air-fuel supply line, operative to feed said input port with an air-fuel mixture;

an igniter, associated with said air-fuel supply line, which ignites the air-fuel mixture in said supply line and initiates a burning front which propagates towards said input port; and a turbulence stimulator, fixedly mounted in said combustion chamber, which enhances and controls burning of said air-fuel mixture and comprises:

a first section, situated within the combustion portion of the combustion chamber and having a preselected first gas dynamic resistance; and a second section, situated within the detonation portion of the combustion chamber and having a preselected second gas dynamic resistance, lower than the first resistance, wherein said first resistance is such that burning of the air-fuel mixture in said combustion portion yields a predetermined pressure level suitable for initiating detonation of the remaining air-fuel mixture, in said detonation portion, and wherein said second resistance supports continued detonation of the remaining air-fuel mixture in the detonation portion.

2. A shock wave generator according to claim 1 wherein said air-fuel supply line is associated with said input port via a perforated nozzle which scatters said burning front substantially upon entry of the burning front into said combustion chamber.

3. A shock wave generator according to claim 1 wherein said turbulence generator comprises a plurality of gas dynamic obstructers positioned at fixed locations along the combustion chamber to yield said preselected first and second gas dynamic resistances along said combustion and detonation portions, respectively.

4. A shock wave generator according to claim 2 wherein said turbulence generator comprises a plurality of gas dynamic obstructers positioned at fixed locations along the combustion chamber to yield said preselected first and second gas dynamic resistances along said combustion and detonation portions, respectively.

5. A generator according to claim 3 wherein each obstructer includes a plurality of rods, generally perpendicular to the direction of propagation of the burning front in said combustion chamber.

6. A generator according to claim 5 wherein said plurality of rods are arranged such that they define a generally helical path, having a predetermined pitch.

7. A shock wave generator comprising:

a combustion chamber having an input port and an output aperture;

an air-fuel supply line operative to feed the input port with an air-fuel mixture;

an igniter, associated with said air-fuel supply line, which ignites the air-fuel mixture in said supply line and initiates a burning front which propagates towards said input port;

a turbulence stimulator, fixedly mounted in said combustion chamber, which enhances and controls burning of said air-fuel mixture; and a perforated nozzle, associated with said input port, which scatters said burning front substantially upon entry of the burning front into said combustion chamber.

8. A method of generating a shock wave using a two-phase burning process, comprising the steps of:

supplying an air fuel mixture from an air-fuel supply line to a combustion chamber;

igniting the air-fuel mixture in said supply line when said combustion chamber is filled with a preselected amount of air-fuel mixture, thereby initiating a burning front propagating towards said combustion chamber; and enhancing and controlling the burning process by stimulating turbulence in said combustion chamber, wherein the turbulence is stimulated by the steps of:

imposing a preselected first gas dynamic resistance in said combustion portion during a first, combustion, phase of said burning process; and imposing a preselected second gas dynamic resistance, lower than the first gas dynamic resistance, during a second, detonation, phase of said burning process, and wherein said first resistance is such that burning of the air-fuel mixture during said combustion phase yields a predetermined pressure level suitable for initiating detonation of the remaining air-fuel mixture, during said detonation phase, and wherein said second resistance ensures controlled detonation of the remaining air-fuel mixture.

9. A method according to claim 8 and further comprising the step of scattering the burning front substantially upon entry of the burning front into said combustion chamber.

10. A method of generating a shock wave comprising the steps of:

supplying an air fuel mixture from an air-fuel supply line to a combustion chamber;

igniting the air-fuel mixture in said supply line when said combustion chamber is filled with a preselected amount of air-fuel mixture, thereby initiating a burning front propagating towards said combustion chamber;

scattering the burning front upon entry of the burning front into said combustion chamber;

enhancing and controlling said burning process by stimulating turbulence in said combustion chamber; and detonating the air fuel mixture in said combustion chamber.

11. A method according to claim 8 and further comprising the step of removing the detonated mixture at an aperture to form a gas dynamic pulse thereat.

12. A method according to claim 9 and further comprising the step of removing the detonated mixture at an aperture to form a gas dynamic pulse thereat.

13. A method according to claim 10 and further comprising the step of removing the detonated mixture at an aperture to form a gas dynamic pulse thereat.

* * * * *